US006348762B1

(12) United States Patent
Nunomura et al.

(10) Patent No.: US 6,348,762 B1
(45) Date of Patent: Feb. 19, 2002

(54) SURFACE DISCHARGE TYPE COLOR PLASMA DISPLAY PANEL

(75) Inventors: Keiji Nunomura; Kazuaki Yanagida, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/418,812

(22) Filed: Oct. 15, 1999

(30) Foreign Application Priority Data

Oct. 16, 1998 (JP) ..... 10-309553

(51) Int. Cl.[7] ..... H01J 17/49
(52) U.S. Cl. ..... 313/582; 313/584
(58) Field of Search ..... 313/582, 584, 313/585, 586, 631

(56) References Cited

U.S. PATENT DOCUMENTS 5,640,068 A * 6/1997 Amemiya ..... 313/582

FOREIGN PATENT DOCUMENTS

| | | |
|---|---|---|
| JP | 63-149053 | 9/1988 |
| JP | 63-274090 | 11/1988 |
| JP | 1-73881 | 5/1989 |
| JP | 7-226945 | 8/1995 |
| JP | 07-226945 | 8/1995 |
| JP | 09-265913 | 10/1997 |
| JP | 10-92326 | 4/1998 |
| JP | 10-123501 | 5/1998 |
| JP | 2000-11894 | 1/2000 |

* cited by examiner

*Primary Examiner*—Vip Patel
(74) *Attorney, Agent, or Firm*—Hutchins, Wheeler & Dittmar

(57) ABSTRACT

A surface discharge type color plasma display panel (PDP) having high color temperature and small white color deviation. The plasma display panel comprises: a plurality of discharge electrode pairs each of which includes a scanning electrode and a retaining electrode and each of which form a surface discharge gap between the scanning electrode and the retaining electrode; a plurality of data electrodes disposed perpendicular to the surface discharge gap; and a plurality of display cells each defined at an area including an intersection between the data electrode and the discharge electrode pair, the plurality of display cells being grouped into a plurality of sets of display cells, each set including display cells for three primary colors. The discharge electrode pair in each set of display cells having the same shape among said display cells of three primary colors in the proximity of said surface discharge gap, and having different shapes among said display cells of three primary colors at portions remote from the surface discharge gap.

19 Claims, 18 Drawing Sheets

PRIOR ART

PRIOR ART

SURFACE DISCHARGE TYPE COLOR PLASMA DISPLAY PANEL

FIELD OF THE INVENTION

The present invention relates generally to a color plasma display panel (a color PDP) used in a flat panel type television et, a display for displaying information, and the like, and more particularly to a color plasma display panel of a surface discharge type which has a superior white color characteristic and which can display a vivid color image.

BACKGROUND OF THE INVENTION

A plasma display is a display device which displays an image and so on by exciting fluorescent substance by using ultraviolet rays produced by gas discharge to emit light. The plasma display is expected to be applied to a large picture size television set, an information display, and the like.

Various types of color plasma displays have been developed. As typical types of the color plasma displays, there are a DC pulse memory type display and an AC memory type display. At present, the AC memory type is mainly used industrially because of the lifetime and the luminous efficiency. The AC memory type display is also categorized into an opposed electrode discharge type, a plane discharge type, and the like, depending on the cell structure, the electrode structure and so on. In particular, a reflection type AC surface discharge plasma display is superior in the luminance, easiness of panel fabrication, and the like.

FIGS. 16A through 16C illustrate a panel structure of a typical reflection type AC surface discharge color plasma display. FIG. 16A is an elevational structural view in which a portion of a rear substrate 200 is cut away. FIG. 16B illustrates a structure at a cross section of a front substrate 100. FIG. 16C illustrates a structure at a cross section of the rear substrate 200.

The front substrate 100 which is on the side of a viewer comprises a glass substrate 1 and many band shaped transparent electrodes 3 formed in parallel on the glass substrate 1, in a horizontal direction. On each of the transparent electrodes 3, a bus electrode 4 is formed which bus electrode 4 is a band shaped narrow electrode to lower resistance of the transparent electrode 3. The transparent electrodes 3 are formed of a thin film of ITO (Indium Tin Oxide) or tin oxide. However, the resistance of each transparent electrode 3 should be sufficiently small in order to conduct a discharge current sufficient to emit light in a large size panel, and, therefore, the bus electrode 4 made of metal having good conductivity is attached to each of the transparent electrodes 3 to lower the resistance thereof. The bus electrode 4 is made, for example, of a thick film of silver or a thin film of copper, aluminum, or chromium. On such structure including the transparent electrodes 3 and the bus electrodes 4, a dielectric layer 7 and a protective layer 8 are formed. The dielectric layer 7 is fabricated by applying a low melting point glass paste on the structure including the electrodes 3 and 4, and thereafter baking it at a temperature near 600 degrees Celsius. Thereby, the dielectric layer 7 is formed as a transparent insulating layer having a thickness of approximately 20 through 40 microns. The protective layer 8 is formed by vacuum evaporation and the like, and formed of a thin film of magnesium oxide (MgO) which has a large coefficient of secondary electron emission and has a superior anti-sputtering characteristic.

The rear substrate 200 comprises a glass substrate 2 on which band shaped data electrodes 5 are formed in a vertical direction and, thereafter, a dielectric layer 10 having low melting point glass as the basis is formed thereon. Thereafter, band shaped isolation walls 6 are formed in a vertical direction on the dielectric layer 10. Then, at a bottom portion and side walls of each groove formed by the isolation walls 6, powder type fluorescent substance 9 of red, green and blue colors are sequentially applied, and thereby the rear substrate 200 is completed. The isolation walls 6 secure discharge spaces, and serve to prevent cross talk of discharge and to prevent blotting of emitted light. Approximately, the isolation walls 6 are 30 through 100 microns in width and 80 through 200 microns in height.

The above-mentioned front substrate 100 and the rear substrate 200 are opposed to each other such that the protective layer 8 of the front substrate 100 is opposed to the isolation walls 6 of the rear substrate 200. Both substrates 100 and 200 are then sealed at the periphery thereof by a fritted glass to obtain a panel assembly. The panel assembly is heated and evacuated, and discharge gas having rare gas as the basis thereof is introduced, thereby the plasma display panel is completed.

On the front substrate 100, the transparent electrodes 3 with the bus electrodes 4 are disposed in pairs having a surface discharge gap 11 therebetween. One of the pair of transparent electrodes 3 with bus electrodes 4 is used as a scanning electrode 12, and the other of the pair is used as a retaining or holding electrode 13. Various voltage wave signals are applied to three kinds of electrodes, including the data electrodes 5 mentioned above, in addition to these scanning electrodes 12 and the retaining electrodes 13, thereby the plasma display panel is driven to perform display operation.

FIG. 17 shows an example of waveforms of fundamental drive signals for the AC surface discharge type plasma display panel. Scanning pulses Sc1, Sc2,. . . , ScN are sequentially applied to the scanning electrodes 12-1, 12-2, . . . , 12-N. At the same timing as that of each of the scanning pulses Sc1, Sc2,. . . , ScN, a data pulse Dp is sequentially applied to each of the data electrodes 5 corresponding to a data to be displayed at each display cell. The data pulses have a polarity opposite to that of the scanning pulses. Thereby, a discharge, that is, an opposing electrode discharge, occurs between the scanning electrode 12 and the data electrode 5 opposing to each other. Also, the opposing electrode discharge triggers occurrence of the surface discharge between the retaining electrode 13 and the scanning electrode 12, thereby writing operation is completed. Due to the surface discharge, i.e., a writing discharge, wall charges are produced on the surfaces over the scanning electrode 12 and the retaining electrode 13. In a cell in which wall charges are formed, retaining discharge of the surface discharge, i.e., retaining surface discharge, occurs by retaining pulses Re applied between the retaining electrode 13 and the scanning electrode 12. However, in a cell into which data is not written, retaining discharge does not occur even if the retaining pulses Re are applied, because there is no superimposing effect of electric fields caused by the wall charges. By applying the retaining pulses predetermined times, display of image and so on by light emission is performed.

Also, in order to improve write operation characteristic, a preliminary discharge operation is performed in which a high voltage is applied to all cells before performing write operation, so that any previously stored signals of the cells are erased and discharge is performed forcibly. In FIG. 17, Pd designates a preliminary discharge pulse, and Pe designates preliminary erasure discharge pulse.

As mentioned above, drive operation of a plasma display panel comprises a series of preparing operation, write operation and retained light emission operation. In FIG. 17, a series of such driving operation is shown as an example, in which driving operation of a plasma display panel is separated into a preparing interval in a whole panel, a write interval and a retaining interval. Various driving systems other than the above-mentioned system in which write operation and retain operation are separated can be used, for example, it is possible to use a system in which these operations are mixed. However, when considered in an individual display cell, it is common to these systems that, after preparing operation, write operation is disposed and then retaining operation is disposed.

When tone or gradation of an image and so on is to be displayed in a color plasma display panel, a so-called "sub-field method" is used. In the AC type plasma display, it is difficult to modulate luminance of display emission by using voltage control, and, in order to modulate luminance, it is necessary to change number of times of light emission. In the sub-field method, an image of one page is divided into a plurality of pages of binary images and these binary images are continuously displayed in a high speed so that, by using integrating effect of vision, an image having multiple gradation is reproduced.

In a color plasma display panel, ultraviolet rays from xenon atoms or xenon molecules excited by discharge are converted into light of three primary colors by fluorescent substances coated on an inner wall of each cell, thereby color display is realized. Therefore, luminous efficiency and color purity of the fluorescent substances themselves are very important for a plasma display. Ultraviolet rays from xenon mainly include a resonance line of 147 nm or somewhat broad molecular line whose center is 172 nm, and are vacuum ultraviolet rays having very short wavelength when compared with fluorescent lamp which mainly utilizes ultraviolet rays of 254 nm from mercury. Also, it is necessary for the fluorescent substances of color plasma display panel to withstand high temperature during a manufacturing process of the panel, and also the fluorescent substances are directly exposed to plasma. Therefore, usable fluorescent substance is limited at present. As the fluorescent substances 9, (Y, Gd) $BO_3$: Eu and so on is used for emitting red light, $Zn_2SiO_4$: Mn and so on is used for green, and $BaMgAl_{10}O_{17}$: Eu and so on is used for blue, in a practically used panel.

However, the prior art mentioned above has the following disadvantages.

In order to attain good color light emission display, it is important to obtain good white balance characteristic determined by the balance of luminance of respective three primary colors, as well as color purity of each of three primary colors. In a conventional plasma display, color temperature of white color obtained by simultaneously applying retaining pulses to a red cell, a green cell and a blue cell is approximately 6000 degrees Kelvin, and is not so high. Also, with respect to the white balance of this case, white color deviation from the blackbody radiation curve is approximately +0.01 to +0.02 uv, deviating largely toward green color. This is because, luminance of green and luminance of red are relatively high, and luminance of blue is relatively low. In the original NTSC system, color temperature standard of white color is determined to be 6500 degrees Kelvin. However, recently, higher color temperature is preferred to lower color temperature because of vividness of white color, and 9300 degrees Kelvin is used as a reference white color. Also, in a home television, a higher color temperature exceeding 10000 degrees Kelvin is preferred, and such high color temperature has become common in CRT display. In order to realize vividness of display which is comparable to CRT and in order for the color plasma display panel to be widely used, improvement in color temperature of white color and in white color deviation is important and essential.

In a surface discharge type color plasma display in which cells of three primary colors are disposed along surface discharge electrodes as a row electrode, retaining pulses are applied simultaneously to the cells of three colors and it is impossible to apply retaining pulses independently to a cell of each color. Therefore, difference of performance of the fluorescent substance 9 among respective colors directly influences and determines color temperature of white color. Especially, luminous efficiency of the fluorescent substance 9 of blue color is low in comparison with green color and red color, and, therefore, it is impossible to obtain preferred white color having high color temperature. It is important to improve fluorescent material itself, especially to improve luminous efficiency and color purity of the fluorescent substance 9 of blue color. However, improvement in the fluorescent substance is difficult at present, and other measures are considered to obtain preferred white color.

The simplest way is to deliberately lower luminous efficiency of fluorescent substance of green light and/or red light which have relatively high luminance, by controlling thickness of the fluorescent substance or by compounding powder of fluorescent substance. Although this method is easy to implement, ultraviolet rays generated are wasted and therefore luminous efficiency of the plasma display panel is deteriorated.

In another method, color filters are disposed on the display cells of corresponding colors and each color filter is made such that optical density of each color filter is adjusted to obtain proper color balance. Although reflection of external light can be decreased by the effect of the color filters, this method has disadvantages of decreasing luminous efficiency and of increasing manufacturing cost.

In still another method, luminance of each color is adjusted by controlling video signal level of the color. In this case, when white color is displayed, number of light emission, i.e., number of discharges, of the blue cell is made larger than the number of light emission of the green cell and/or the red cell. However, in the color plasma display panel which displays gradation of an image and so on by a digital system of the sub-field method, such method of controlling luminance decreases number of gradations of green color and/or red color whose luminance should be lowered. For example, the number of gradation of blue color is 256 steps, but the number of gradation of green color becomes 200 steps. Especially, since green color contributes relatively large percentage of luminance, if the number of gradations is decreased, disadvantages arise, for example, deterioration of smoothness of image and so on.

It is also possible to change sizes of discharge cells themselves every color so that intensity of light emission of each color is changed accordingly. As shown in FIG. 18, the sizes of discharge cells can be easily changed by changing pitch of the band shaped isolation walls 6. Also, in case of a plasma display panel having rectangular electrode structure, luminance of each color can be controlled by changing pitch of the isolation walls 6, as shown in Japanese patent laid-open publication No. 7-226945. In such example, however, when the plasma display panel is driven to perform display of image and so on, writing characteristics differs every color, and a drive margin to perform good display as a whole panel decreases. Good writing characteristics mean, for example, that data can be written into a cell stably by using a low potential voltage and that, for every color, data can be written into a cell by the same potential voltage.

SUMMARY OF THE INVENTION

Considering the problems mentioned above, the present invention has been thought out.

It is an object of the present invention to obviate the disadvantages of a conventional color plasma display panel.

It is an object of the present invention to provide a color plasma display panel in which control of chromaticity of white color can be attained without deteriorating luminous efficiency and drive characteristic.

It is another object of the present invention to provide a color plasma display panel in which display of image and so on at high color temperature can be attained without deteriorating luminous efficiency and drive characteristic.

According to an aspect of the present invention, there is provided a surface discharge type color plasma display panel comprising: a plurality of discharge electrode pairs each of which includes a scanning electrode and a retaining electrode and each of which forms a surface discharge gap between the scanning electrode and the retaining electrode; a plurality of data electrodes disposed perpendicular to the surface discharge gap; and a plurality of display cells each defined at an area including an intersection between the data electrode and the discharge electrode pair. The plurality of display cells are grouped into a plurality of sets of display cells, and each set includes display cells for three primary colors. The discharge electrode pair in each set of display cells has the same shape among the display cells of three primary colors in the proximity of the surface discharge gap, and has different shapes among the display cells of three primary colors at portions remote from the surface discharge gap.

It is preferable that the color plasma display panel further comprises isolation walls which are disposed parallel with the data electrodes and which define discharge spaces of display cells, and that the scanning electrode and the retaining electrode comprise a pair of transparent electrodes.

It is also preferable that an area of the discharge electrode pair in the display cell of blue color is larger than an area of the discharge electrode pair in each of the display cells of other colors.

Further, it is preferable that the scanning electrode and the retaining electrode are a pair of transparent electrodes, and that each of the transparent electrodes has comb like shape in which recessed portions are formed from the surface discharge gap along portions facing isolation walls provided perpendicular to the surface discharge gap.

In this case, end portions of the transparent electrodes on opposite side of the surface discharge gaps may have stepped portions in locations which face portions between the isolation walls, and widths of the transparent electrodes in a direction along the isolation walls may differ every color.

Also, end portions of the transparent electrodes on the side of the retaining electrodes on opposite side of the surface discharge gap may have stepped portions in locations which face portions between the isolation walls, and widths of the transparent electrodes on the side of the retaining electrodes in a direction along the isolation walls may differ every color.

It is preferable that the transparent electrodes have slits which are formed on the portions opposite to the surface discharge gap and at locations facing portions between the isolation walls and whose sizes are changed every color to control color temperature of white color.

It is also preferable that the plasma display panel further comprises bus electrodes which extend parallel to the surface discharge gaps, which are disposed on the outside of the transparent electrodes and on the opposite side of the surface discharge gaps and which are electrically coupled with the transparent electrodes via connecting portions disposed along portions facing the isolation walls, and that there are provided gaps between the transparent electrodes and the bus electrodes, the gaps being provided for changing areas of the discharge electrodes contributing to retaining discharge.

In this case, shapes of the gaps may be changed every color to control areas of said discharge electrodes contributing to retaining discharge.

It is also preferable that the transparent electrodes has recessed portions at location including portions facing the isolation walls which has approximately comb teeth like shape, that tip portions of the transparent electrodes which are not recessed are electrically coupled with the bus electrodes, and that widths, in the direction of the bus electrodes, of the transparent electrodes which are not recessed are different every color.

It is further preferable that the transparent electrodes have transparent electrode portions each of which has approximately rectangular shape, and that lengths of the transparent electrode portions in the direction of the isolation walls differ every color.

The transparent electrodes may have transparent electrode portions each of which has approximately rectangular shape, and each of the transparent electrode portions may have constricted portion on the side of the bus electrode.

Also, the transparent electrodes may have recessed portions on the side of the surface discharge gap and at the location facing the isolation walls, and bus electrodes and the transparent electrodes may be electrically coupled via connecting portions located at portions facing the isolation walls.

In this case, the connecting portions may be formed of a material which is the same as that of the bus electrodes.

Also, the transparent electrodes may have recessed portions on the side of the surface discharge gap and at the location facing the isolation walls, and also may have recessed portions on the side of the bus electrodes toward the surface discharge gap and at the location corresponding to portions between the isolation walls.

It is also preferable that the scanning electrodes and the retaining electrodes are transparent electrodes constituting discharge electrode pairs, that the transparent electrodes have transparent electrode portions which are mutually separated by isolation walls, which have approximately rectangular shape and which have connecting portions having narrow band shape, the transparent electrode portions and bus electrodes are electrically coupled via the connecting portions, and length of the connecting portions differ every color.

It is also preferable that the scanning electrodes and the retaining electrodes are transparent electrodes constituting discharge electrode pairs, that the transparent electrodes have transparent electrode portions which are mutually separated by isolation walls, which have approximately rectangular shape and which have connecting portions for electrically coupling the transparent electrode portions and bus electrodes, and width of the connecting portions differ every color.

It is further preferable that width of each of the data electrodes is wider at portions facing end portions of the scanning electrode on the side of the surface discharge gap than at portions facing other end portions of the scanning electrode on opposite side of the surface discharge gap.

It is also preferable that fluorescent substance of three primary colors are sequentially applied on regions between the isolation walls.

BRIEF DESCRIPTION OF THE DRAWINGS

These and other features, and advantages, of the present invention will be more clearly understood from the following detailed description taken in conjunction with the accompanying drawings, in which like reference numerals designate identical or corresponding parts throughout the figures, and in which.

DESCRIPTION OF A PREFERRED EMBODIMENT

With reference to the drawings, embodiments of the present invention will now be described in detail.

Embodiment 1

Figure 1A:
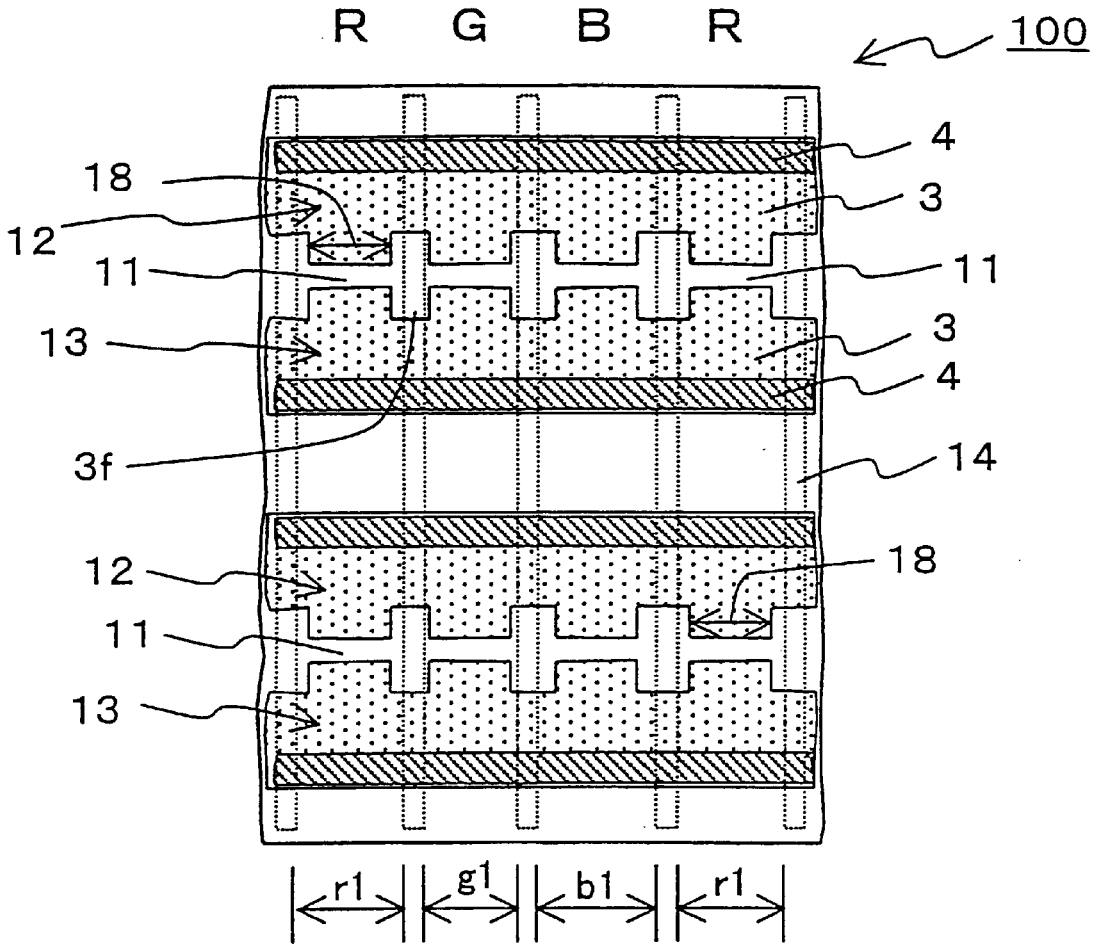
FIG. 1A is an elevational view illustrating an electrode structure of a color plasma display panel in accordance with a first embodiment of the present invention.
Figure 1B:
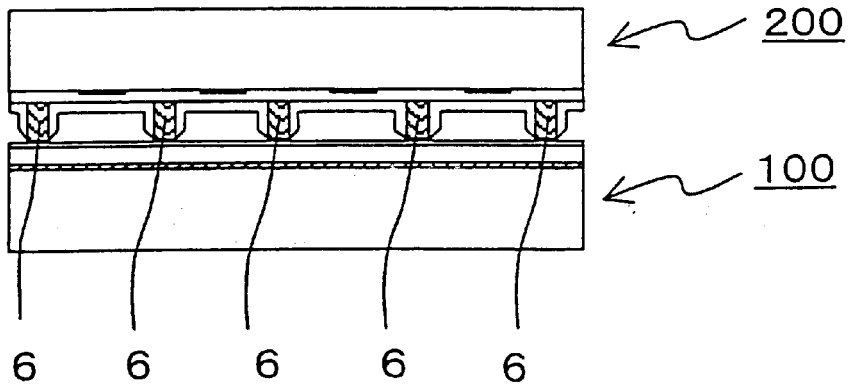
FIG. 1B is a bottom view illustrating a cross sectional structure of a color plasma display panel shown in FIG. 1A.

FIG. 1A and FIG. 1B illustrate a panel structure of a color plasma display panel according to a first embodiment of the present invention. The color plasma display panel of FIGS. 1A and 1B is a reflection type AC surface discharge plasma display panel. FIG. 1A is an elevational structural view of a front substrate 100 in which a rear substrate 200 is removed. FIG. 1B illustrates a cross sectional structure of the plasma display panel of FIG. 1A including both the front substrate 100 and the rear substrate 200. In FIG. 1A, reference numeral 14 designates isolation wall portions 14 which show locations of isolation walls 6 of the rear substrate 200 when the front substrate 100 and the rear substrate 200 are assembled.

The front substrate 100 comprises a glass substrate 1 and many elongated transparent electrodes 3 formed in parallel on the glass substrate 1, for example, in a horizontal direction. On each of the transparent electrodes 3, a bus electrode 4 is formed which bus electrode 4 is a band shaped narrow electrode to lower resistance of the transparent electrode 3. The transparent electrodes 3 are formed of a thin film of, for example, ITO (Indium Tin Oxide) or tin oxide. Since the resistance of each transparent electrode 3 should be sufficiently small such that a discharge current sufficient to emit light can be conducted throughout a large size panel, the bus electrode 4 made of metal having good conductivity is attached to each of the transparent electrodes 3 to lower the resistance thereof. The bus electrode 4 is made, for example, of a thick film of silver or a thin film of copper, aluminum, or chromium. On such structure including the transparent electrodes 3 and the bus electrodes 4, a dielectric layer 7 and a protective layer 8 are formed. For example, the dielectric layer 7 is fabricated by applying a low melting point glass paste on the structure including the electrodes 3 and 4, and thereafter baking it at a temperature near 600 degrees Celsius. Thereby, the dielectric layer 7 is formed as a transparent insulating layer having a thickness of approximately 20 through 40 microns. The protective layer 8 is formed by vacuum evaporation and the like of magnesium oxide (MgO) which has a large coefficient of secondary emission and has a superior anti-sputtering characteristic.

The rear substrate 200 comprises a glass substrate 2 on which band shaped data electrodes 5 are formed, for example, in a vertical direction and thereafter a dielectric layer 10 having low melting point glass as the basis is formed thereon. Thereafter, band shaped isolation walls 6 are formed in a vertical direction on the dielectric layer 10.

Then, at a bottom portion and side walls of each groove formed by the isolation walls 6, powder type fluorescent substances 9 of red, green and blue colors are sequentially applied, and thereby the rear substrate 200 is fabricated. The isolation walls 6 secure discharge spaces, and serve to prevent cross talk of discharge and to prevent blotting of emitted light. Approximately, the isolation walls 6 are 30 through 100 microns in width and 80 through 200 microns in height.

It should be noted that, in the attached figures, positional relation of up and down of the bus electrodes 4 and the transparent electrodes 3 are neglected, in order to clearly show a two-dimensional positional relation of components.

As shown in FIG. 1B, the above-mentioned front substrate 100 and the rear substrate 200 are opposed to each other such that the protective layer 8 of the front substrate 100 opposes to the isolation walls 6 of the rear substrate 200. Both substrates 100 and 200 are then sealed at the periphery thereof by a fritted glass to obtain a panel assembly. The panel assembly is heated and evacuated, and discharge gas having rare gas as the basis is enclosed, thereby the plasma display panel is completed.

The transparent electrodes 3 with the bus electrodes 4 are disposed in pairs on the front substrate 100 and have surface discharge gaps 11 therebetween. One of the pair of transparent electrodes 3 with bus electrodes 4 is used as a scanning electrode 12, and the other of the pair is used as a retaining or holding electrode 13. Various voltage wave signals are applied to three kinds of electrodes including the data electrodes 5 mentioned above in addition to these scanning electrodes 12 and the retaining electrodes 13, thereby the plasma display panel is driven to perform display operation.

Figure 18A:
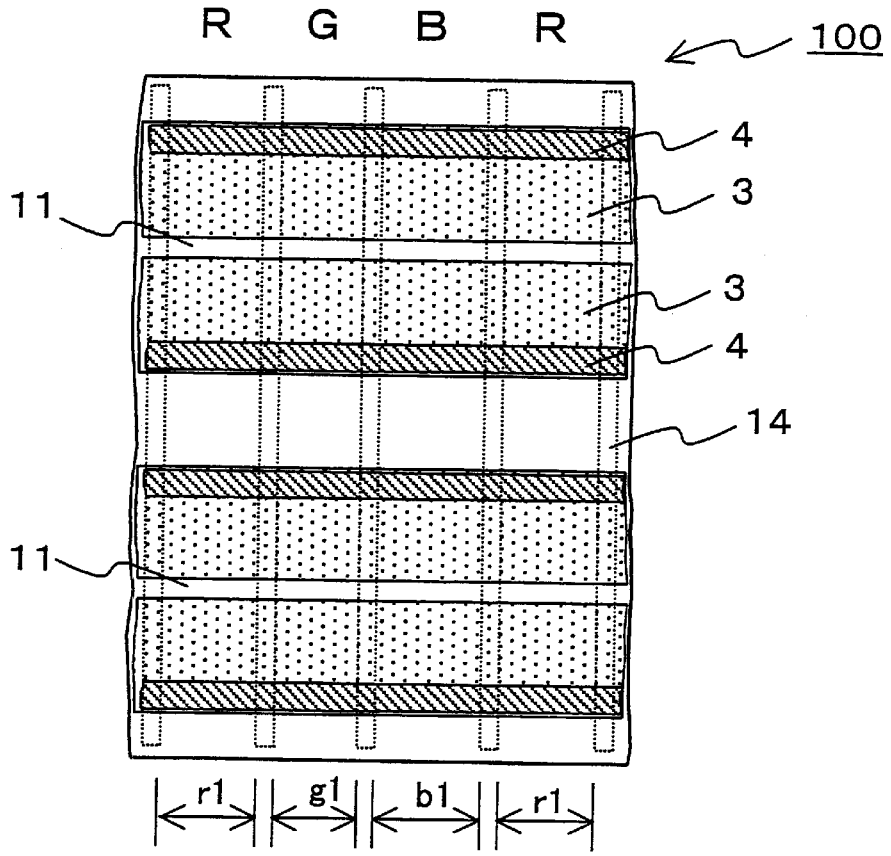
FIG. 18A is an elevational view illustrating an electrode structure of another conventional color plasma display panel.
Figure 18B:
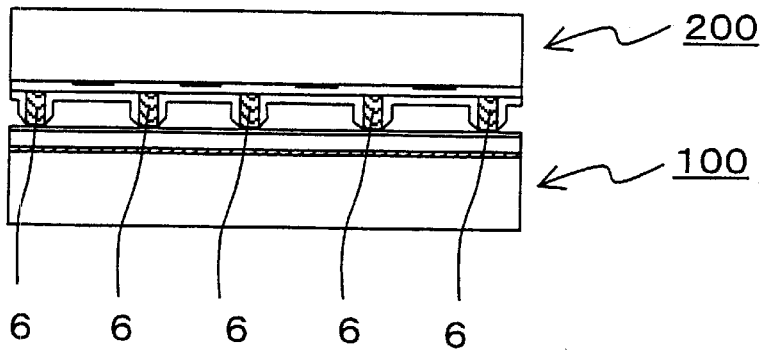
FIG. 18B is a bottom view of the conventional color plasma display panel of FIG. 18A.

In the color plasma display panel of this embodiment, pitches of the band shaped isolation walls 6 are changed every color, similarly to the plasma display panel of FIGS. 18A and 18B. An overall pitch of picture elements (pixels) including display cells of red, green and blue is 1.2 mm in both horizontal direction and vertical direction. Width of the isolation wall 6 is approximately 70 microns. However, spaces between the isolation walls are not uniform. Red display cell R, green display cell G and blue display cell B are sequentially disposed at the respective spaces between the isolation walls 6, and, in this embodiment, width r1 of the red display cell R is 305 microns, width g1 of the green display cell G is 305 microns, and width b1 of the blue display cell B is 380 microns.

The plasma display panel of this embodiment differs from the plasma display panel of FIG. 18 in that, in the plasma display panel of this embodiment, the transparent electrodes 3 are patterned such that incisions or recessed portions 3*f* are formed at the locations of the isolation wall portions 14. Width 18 of each of the remaining portions of the transparent electrodes 3, i.e., projected portions, between the recessed portions 3*f* is approximately the same among red cell, green cell and blue cell. In the conventional plasma display panel, the blue cell whose cell width is wider than that of other cells has somewhat different characteristics such as different write characteristic and so on, so that overall operation margin is deteriorated. However, in this embodiment, by using the transparent electrodes 3 having the above-mentioned structure, write-in characteristics of respective colors can be equalized, and operation margin can also improved. This is because, a discharge voltage and write-in characteristics are determined by the structure or shape in the vicinity of the surface discharge gap 11.

In this embodiment, the width 18 of each of the projected portions of the transparent electrodes 3 is 250 microns for all colors. In case the depth of each of the recessed portions 3*f* is small, effect of matching drive characteristics of respective colors becomes small. When the depth is equal to or larger than 50 microns, discernible improvement of the effect was obtained. On the contrary, if the depth of each of the recessed portion 3*f* is too large, the difference of electrode areas among respective colors becomes small and effect of adjusting color balance is decreased. Therefore, in this embodiment, the depth of the recessed portion 3*f* was determined to be 100 microns.

The color plasma display panel according to the first embodiment having the above-mentioned structure has the following advantageous effects.

When compared with the conventional plasma display panel, luminance of light emission of blue color becomes high. In the conventional plasma display panel, a color temperature of white color was approximately 6000 degrees Kelvin, and deviation of white color was relatively large and was +0.015 uv. The conventional plasma display panel displayed a white color having low color temperature and slightly having a greenish tinge. However, in the plasma display panel according to this embodiment, color temperature of white color is 8000 degrees Kelvin, and deviation of white color is equal to or smaller than 0.005 uv. Also, the plasma display panel according to this embodiment can display a vivid white color.

In the above-mentioned plasma display panel according to the first embodiment, the pitch of the isolation walls 6 is made non-uniform, in order to change areas of discharge electrodes of respective colors. However, in such plasma display panel, it was somewhat difficult to obtain large manufacturing yield of the plasma display panel during a process of fabricating the isolation walls 6 and a process of applying fluorescent paste on areas between the isolation walls 6. In order to further improve manufacturing yield of the plasma display panel, a structure was devised in which, in place of changing the pitch of the isolation walls 6 and in place of changing the sizes of the discharge cells every colors, only the areas of discharge electrodes are adjusted every color. A plasma display panel having such structure will be described below as second through seventh embodiments.

Embodiments 2–7

Figure 2:
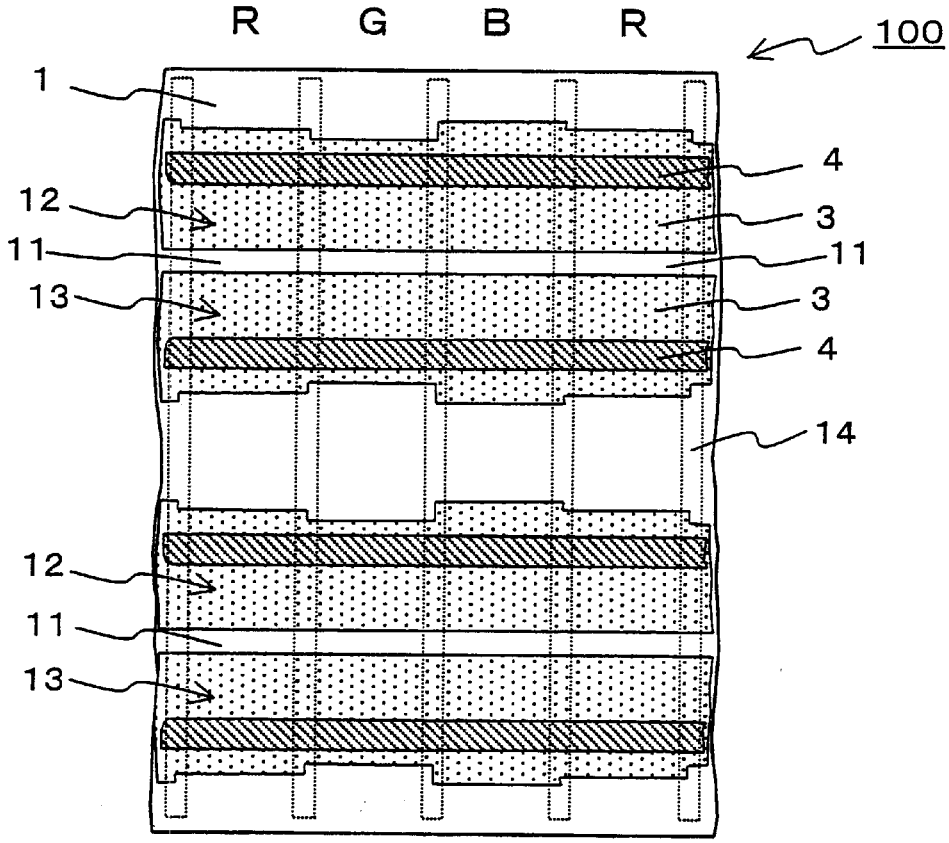
FIG. 2 is an elevational view illustrating an electrode structure of a color plasma display panel in accordance with a second embodiment of the present invention.
Figures 16A, 16B, 16C:
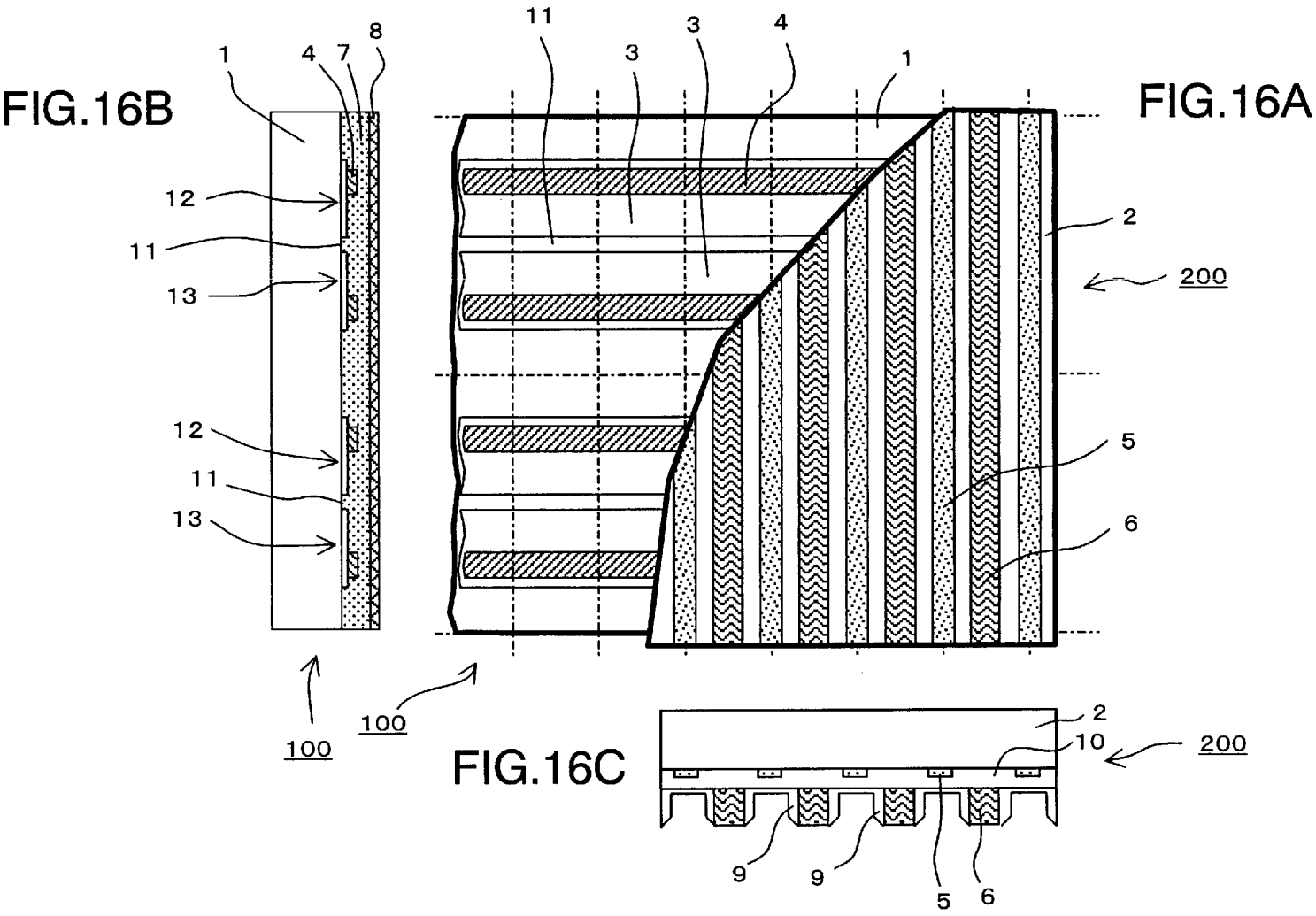
FIG.16C PRIOR ART
FIG. 16A is an elevational view illustrating a structure of a conventional color plasma display panel.
FIG. 16B is a side view of a front substrate of the conventional color plasma display panel of FIG. 16A.
FIG. 16C is a bottom view of a rear substrate of the conventional color plasma display panel of FIG. 16A.
Figure 17:
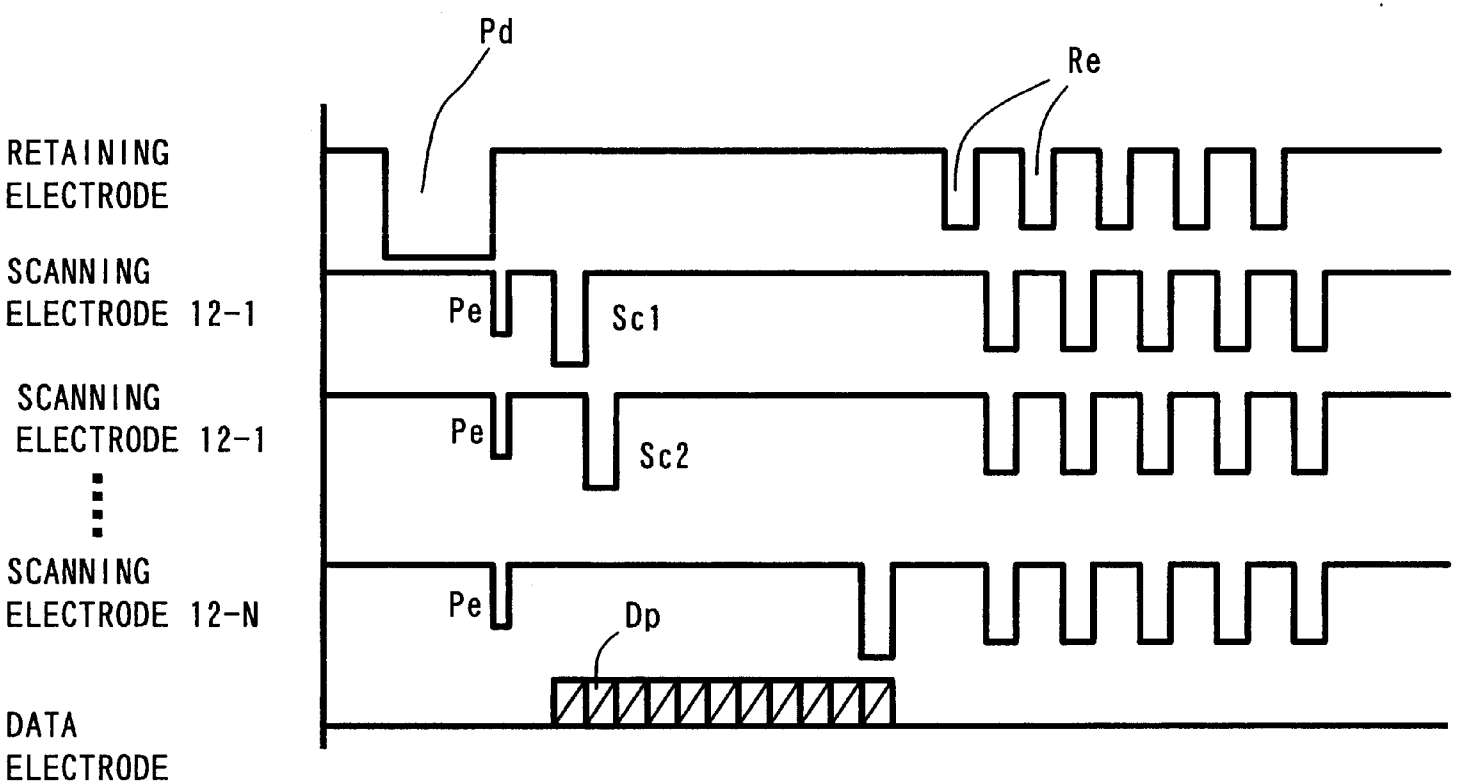
FIG. 17 is a waveform diagram showing waveforms of various drive signals of the color plasma display panel of FIGS. 16A through 16C.

FIG. 2 illustrates a structure of surface discharge electrodes of a plasma display panel according to the second embodiment. The structure of the plasma display panel of FIG. 2 may be the same as that of the plasma display panel of the firts embodiment (FIG. 1), except that the pitch of the isolation walls 6 is constant through all colors and that shape of transparent electrodes 3 is different from that of the first embodiment. Also, the structure of the plasma display panel of FIG. 2 may be the same as that of the plasma display panel shown in FIGS. 16A through 16C, except that the shape of transparent electrodes 3 is different from that of the plasma display panel shown in FIGS. 16A through 16C.

As shown in FIG. 2, each of the transparent electrodes 3 has a linear shape on the side of a surface discharge gap 11, but has a stepwise shape on the opposite side. Also, the width of each of the transparent electrodes 3, that is, the depth of each of the surface discharge electrodes, is narrower at a red cell portion or at a green cell portion than that at a blue cell portion, thereby the areas of the electrodes are adjusted accordingly. In this embodiment, when compared with the conventional plasma display panel shown in FIGS. 16A through 16C, the areas of the electrodes are adjusted such that luminance of blue color becomes higher, color temperature of white color becomes higher, and also the deviation of white color becomes smaller.

Figure 3:
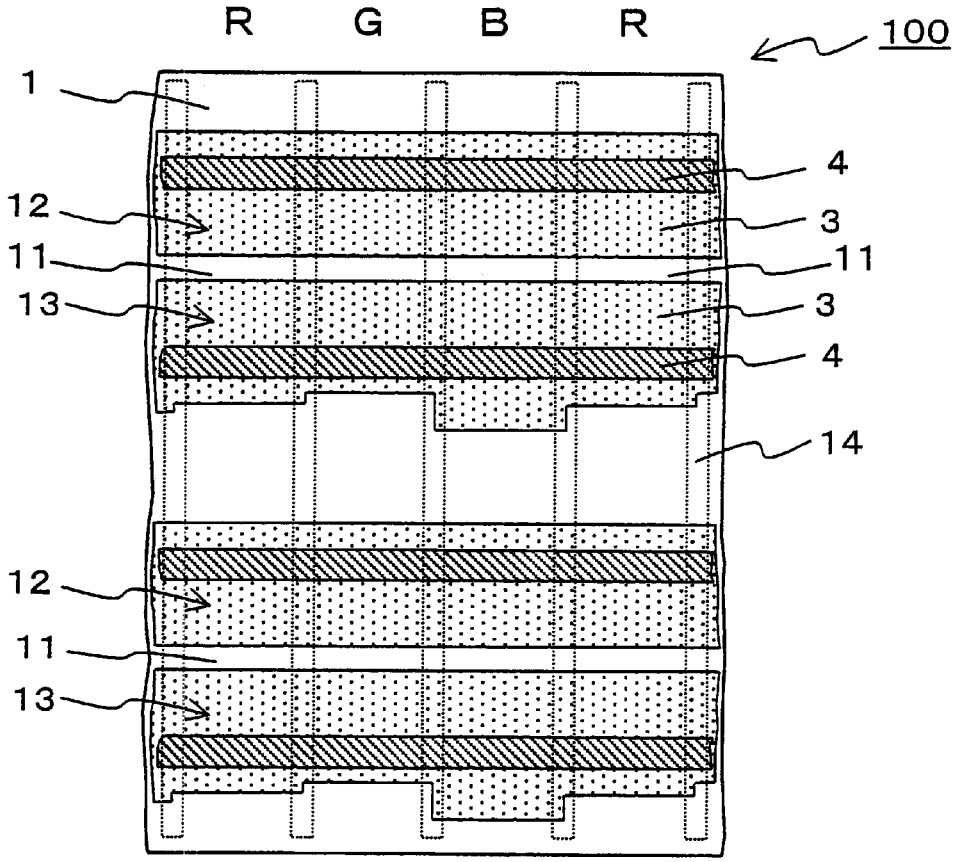
FIG. 3 is an elevational view illustrating an electrode structure of a color plasma display panel in accordance with a third embodiment of the present invention.

In the second embodiment shown in FIG. 2, the areas of the electrodes are changed in both the scanning electrodes 12 and the retaining electrodes 13 constituting the surface discharge electrodes. However, as a third embodiment shown in FIG. 3, it is possible to change areas of only one of the scanning electrodes 12 and the retaining electrodes 13. Even in such structure, luminance of each cell depends of the area of the cell. In this case, it is preferable to keep areas of the electrodes in the scanning electrodes 12 uniform and to change areas of the electrodes in the retaining electrodes 13 every color. This is because, change of areas of the scanning electrodes 12 gives relatively large influence on the writing characteristics.

Figure 4:
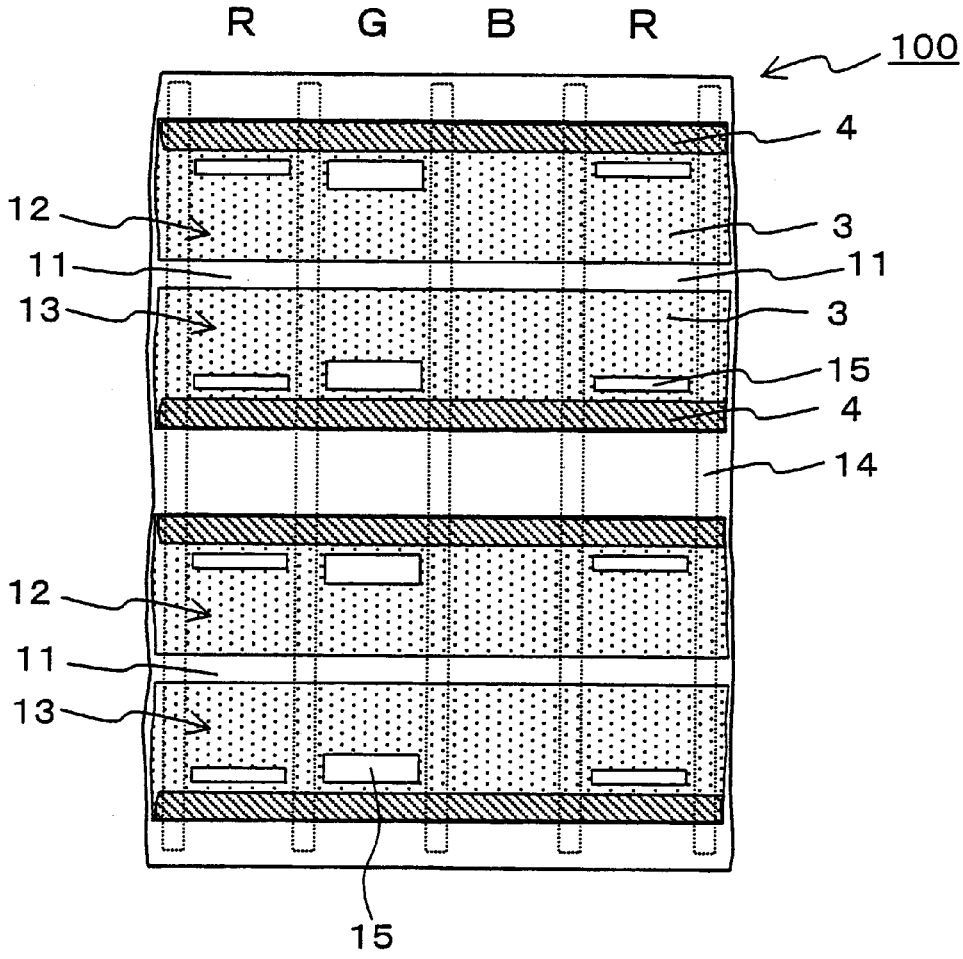
FIG. 4 is an elevational view illustrating an electrode structure of a color plasma display panel in accordance with a fourth embodiment of the present invention.

FIG. 4 illustrates a plasma display panel according to a fourth embodiment of the present invention. In this embodiment, slits 15 are provided in the transparent electrodes 3. The sizes or widths of the slits are changed every color, thereby color temperature of white color can be adjusted. Other portions of the plasma display panel of this embodiment may be the same as that of the plasma display panel of the third embodiment shown in FIG. 3.

Figure 5:
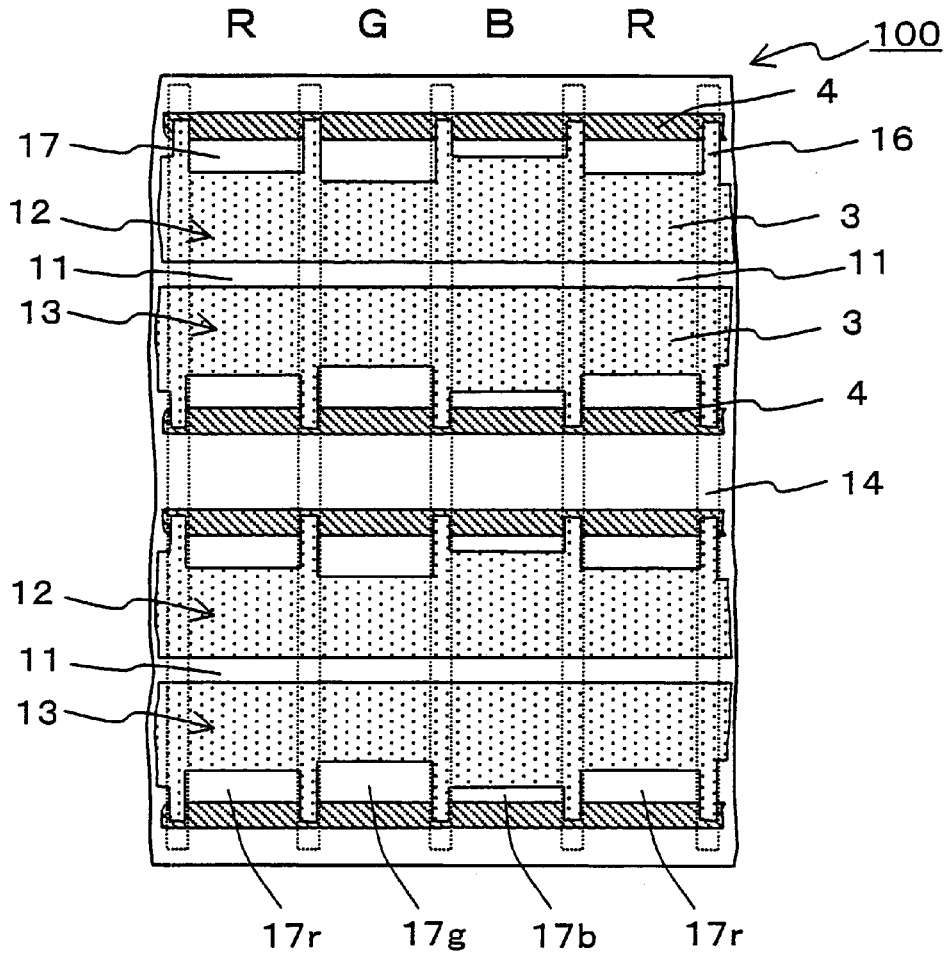
FIG. 5 is an elevational view illustrating an electrode structure of a color plasma display panel in accordance with a fifth embodiment of the present invention.

FIG. 5 illustrates a plasma display panel according to a fifth embodiment of the present invention. In this embodiment, transparent electrodes 3 and bus electrodes 4 are electrically coupled by connecting portions 16. The connecting portions 16 are disposed on the portions corresponding to isolation wall portions 14 and formed, for example, as integrated portions of the transparent electrodes 3. In this structure, discharge does not occur on the bus electrodes 4. Also, in this structure, widths of gaps between the bus electrodes 4 and the transparent electrodes 3 are changed every color, so that areas of discharge electrodes where retaining discharge occurs are changed every color. That is, as shown in FIG. 5, width of each gap between the bus electrode 4 and the transparent electrode 3 is 17*r* for red color cell, 17*g* for green color cell and 17*b* for blue color cell, and these gaps 17*r*, 17*g* and 17*b* are controlled to obtain high color temperature of white color and/or to decrease deviation of white color.

Figure 6:
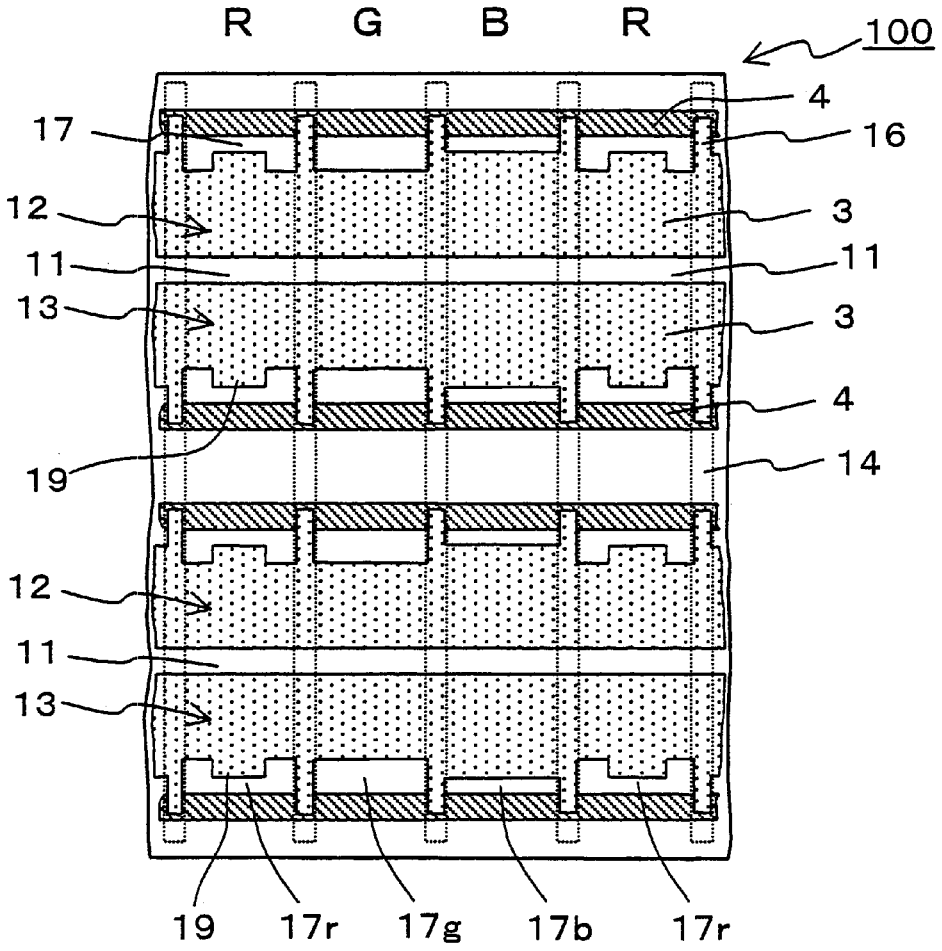
FIG. 6 is an elevational view illustrating an electrode structure of a color plasma display panel in accordance with a sixth embodiment of the present invention.

FIG. 6 illustrates a plasma display panel according to a sixth embodiment of the present invention. The plasma display panel of FIG. 6 is the same as that of FIG. 5, except that transparent electrodes 3 have projected portions 19 in, for example, red color cell. Each of the projected portions 19 increases an area of the discharge electrode.

Figure 7:
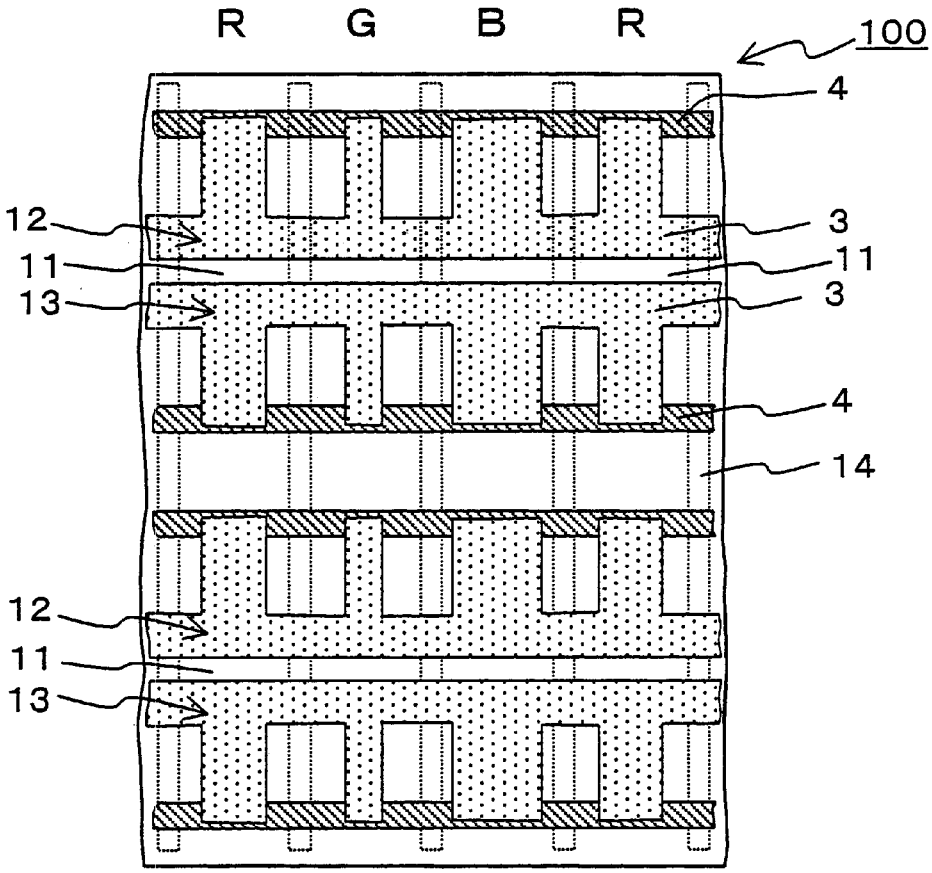
FIG. 7 is an elevational view illustrating an electrode structure of a color plasma display panel in accordance with a seventh embodiment of the present invention.

FIG. 7 illustrates a plasma display panel according to a seventh embodiment of the present invention. In this embodiment, each of transparent electrodes 3 has a straight line shape on the side of a surface discharge gap 11, but has a comb teeth like shape on the other side, and projected portions of the transparent electrode 3 extend toward a bus electrode 4. The projected portions are formed between isolation wall portions 14. The widths of the projected portions differ every color. End portions of the projected portions of the transparent electrode 3 are electrically coupled with the corresponding bus electrode 4. By making width of each projected portion of blue display cell wider than that of each projected portion of display cells of other colors, it becomes possible to raise light emission luminance of blue color and thereby to raise color temperature of white color. Structures of other portions of the plasma display panel of this embodiment may be the same as that of the fifth embodiment shown in FIG. 5.

In the second through seventh embodiments described above, each of the transparent electrodes 3 has a straight line shape on the side of the surface discharge gap 11, and has the same shape from the side of the surface discharge gap 11 until a predetermined width toward the bus electrode 4. Therefore, there is little difference of drive characteristics among respective colors, and drive margin of a whole panel was not deteriorated even if electrode area was changed every color. The above-mentioned predetermined width of the transparent electrode 3, that is, the predetermined width of the transparent electrode 3 from the side of the surface discharge gap 11 toward the bus electrode 4 should be made equal to or lager than 50 microns in the second through sixth embodiments. In the seventh embodiment, the predetermined width, that is, the width of each connecting portion of the transparent electrode 3 connecting between adjacent cells along the surface discharge gap 11 should be made equal to or larger than 50 microns and preferably equal to or larger than 80 microns.

The color plasma display panels according to the second through seventh embodiments constituted as mentioned above have the following advantageous effects, in addition to the advantageous effects of the color plasma display panel according to the first embodiment.

When compared with conventional panels, in the plasma display panels of second through seventh embodiments, light emitting luminance of blue light becomes high, color temperature of white color is raised and deviation of white color becomes small. Also, since the light emitting intensity depends on the area of transparent electrodes 3, it is possible to control the light emitting intensity by changing only areas of the retaining electrodes 13 every color, while areas of the scanning electrodes 12 are maintained constant for every color which give large influence on the writing characteristics. Also, by providing the slits 15 and by changing the size or width of each slit 15 every color, it is possible to control a color temperature of a white color. Further, by changing width of each of the gaps 17 between the bus electrodes 4 and the transparent electrodes 3, area of discharge electrodes in which retaining discharge occurs can be changed to control an intensity of light emission.

Also, by increasing the width of the projected portion of the transparent electrode 3 in each blue cell, light emission luminance of a blue color can be increased to raise a color temperature of a white color.

Embodiments 8–15

Now, with reference to FIG. 8 through FIG. 15, an explanation will be made on plasma display panels according to embodiments 8 through 15 of the present invention, in which recessed portions or cut-in portions are formed in each transparent electrode 3 on the side of a surface discharge gap and at areas corresponding to isolation wall portions 14. In these embodiments, portions not explained below may be the same as those of the plasma display panel, for example, according to the embodiment 2 shown in FIG. 2.

Figure 8:
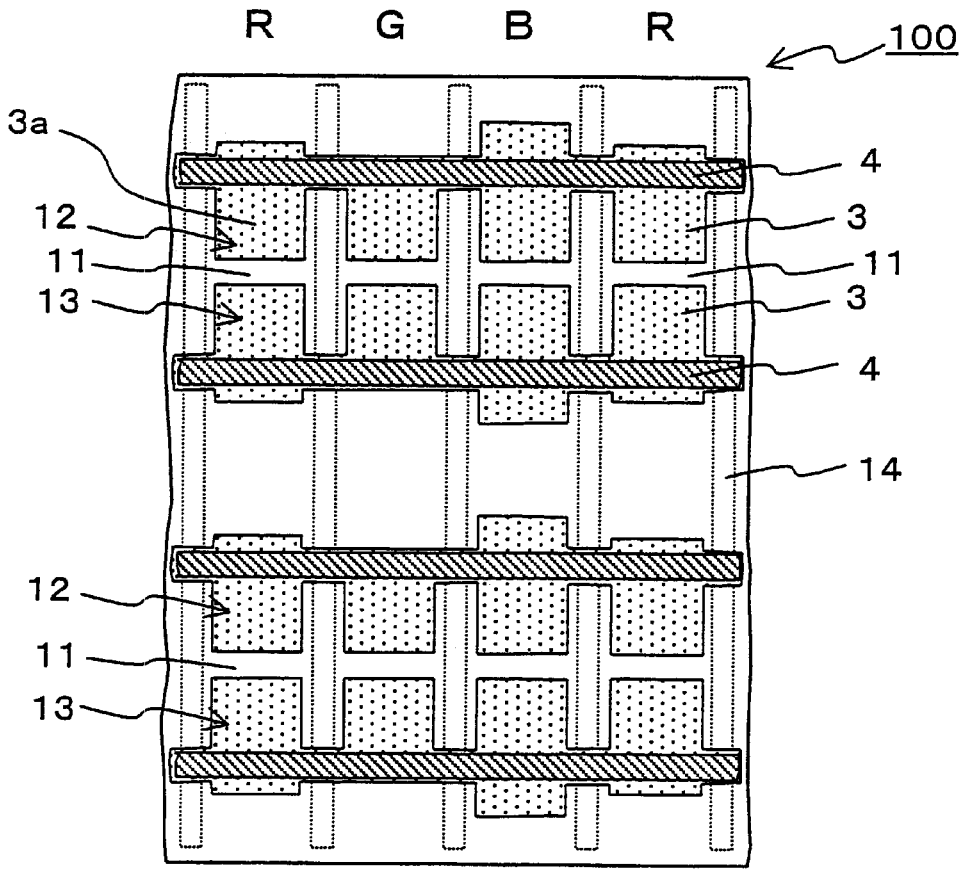
FIG. 8 is an elevational view illustrating an electrode structure of a color plasma display panel in accordance with a eighth embodiment of the present invention.

In the embodiment 8 shown in FIG. 8, each of the transparent electrodes 3 has transparent electrode portions 3*a* each of which is located in a display cell of each color and each of which has approximately rectangular shape. Widths of the transparent electrode portions 3*a* are the same for every color, but depth of the transparent electrode portions 3*a* from the end portions on the side of the surface discharge gaps 11 are adjusted for respective color to control luminance of light emission.

Figure 9:
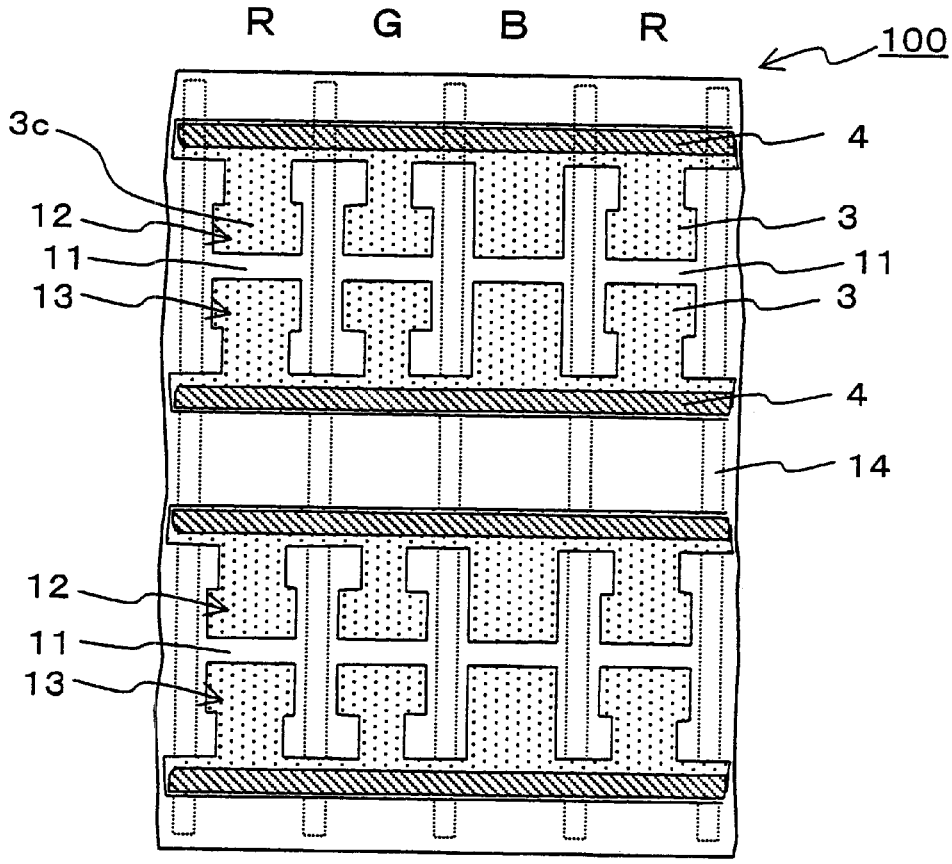
FIG. 9 is an elevational view illustrating an electrode structure of a color plasma display panel in accordance with a ninth embodiment of the present invention.

In the embodiment 9 shown in FIG. 9, each of the transparent electrode portions 3 has transparent electrode portions 3*c* each of which is located in a display cell of each color and each of which has approximately rectangular shape on the side of the surface discharge gap 11. Widths of the transparent electrode portions 3*c* are the same at the tip portions on the side of the surface discharge gaps 11 every color. The transparent electrode portions 3*c* have constricted or narrow portions on the other side of the surface discharge gaps 11, i.e., on the side of the bus electrodes 4. Widths of the transparent electrode portions 3*c* at the constricted portions are adjusted for respective color to control luminance of light emission.

Figure 10:
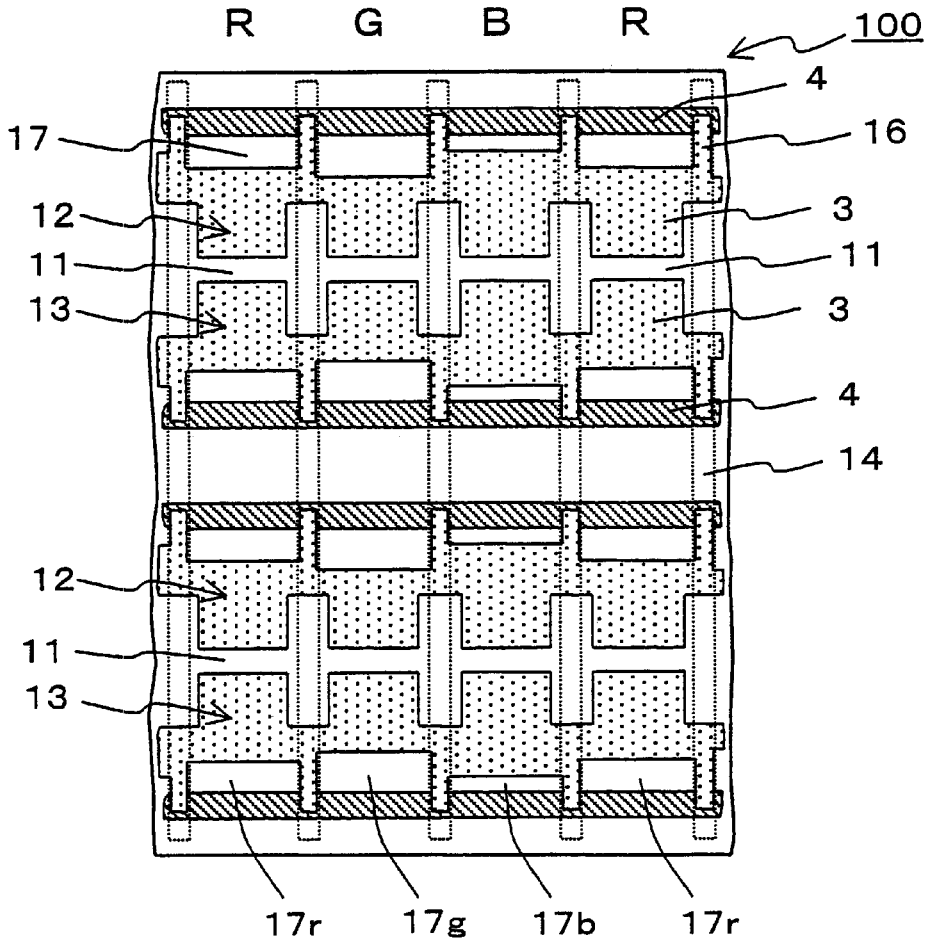
FIG. 10 is an elevational view illustrating an electrode structure of a color plasma display panel in accordance with a tenth embodiment of the present invention.

In the embodiment 10 shown in FIG. 10, each of the transparent electrodes 3 has recessed portions or cut-in portions on the side of the surface discharge gap 11 and has gaps 17 on the side of the bus electrodes 4. Also, each of the transparent electrodes 3 has connecting portions 16 which exist on the isolation wall portions 14 and which connect between the transparent electrode 3 and the corresponding bus electrode 4. The widths of the gaps 17 are adjusted to change areas of discharge electrodes of respective color, thereby luminance of light emission is controlled.

Figure 11:
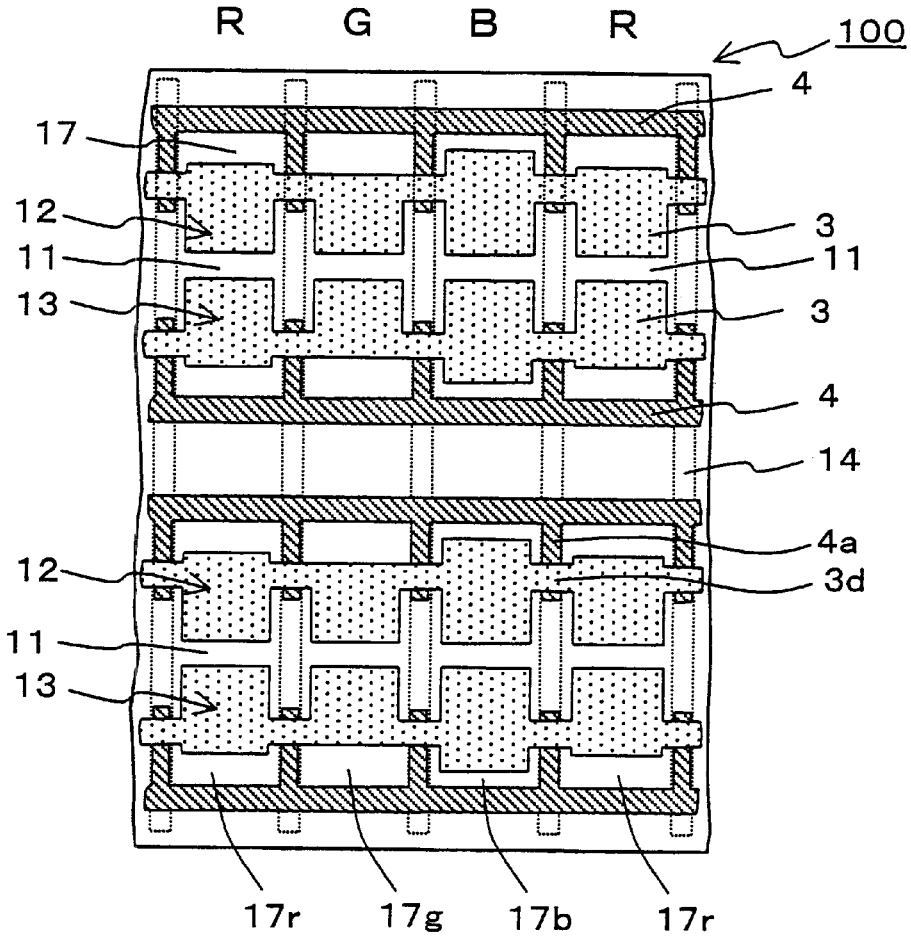
FIG. 11 is an elevational view illustrating an electrode structure of a color plasma display panel in accordance with an eleventh embodiment of the present invention.

In the embodiment 11 shown in FIG. 11, each of the transparent electrodes 3 has approximately the same shape as that of the transparent electrodes 3 of the embodiment 10 shown in FIG. 10, except that, in the embodiment 11, the connecting portions 4*a* are not formed as parts of the transparent electrodes 3 but are formed as parts of the bus electrodes 4. Each of the transparent electrodes 3 has transparent electrode portions 3*a* which are approximately rectangular shape and which are mutually coupled by side connecting portions 3*d*. Each of the transparent electrode 3 and the corresponding bus electrode 4 is connected via the connecting portions 4*a* which are coupled with the side connecting portions 3*d* of the transparent electrode 3. The widths of the gaps 17 are adjusted to change areas of discharge electrodes of respective color, thereby luminance of light emission is controlled.

Figure 12:
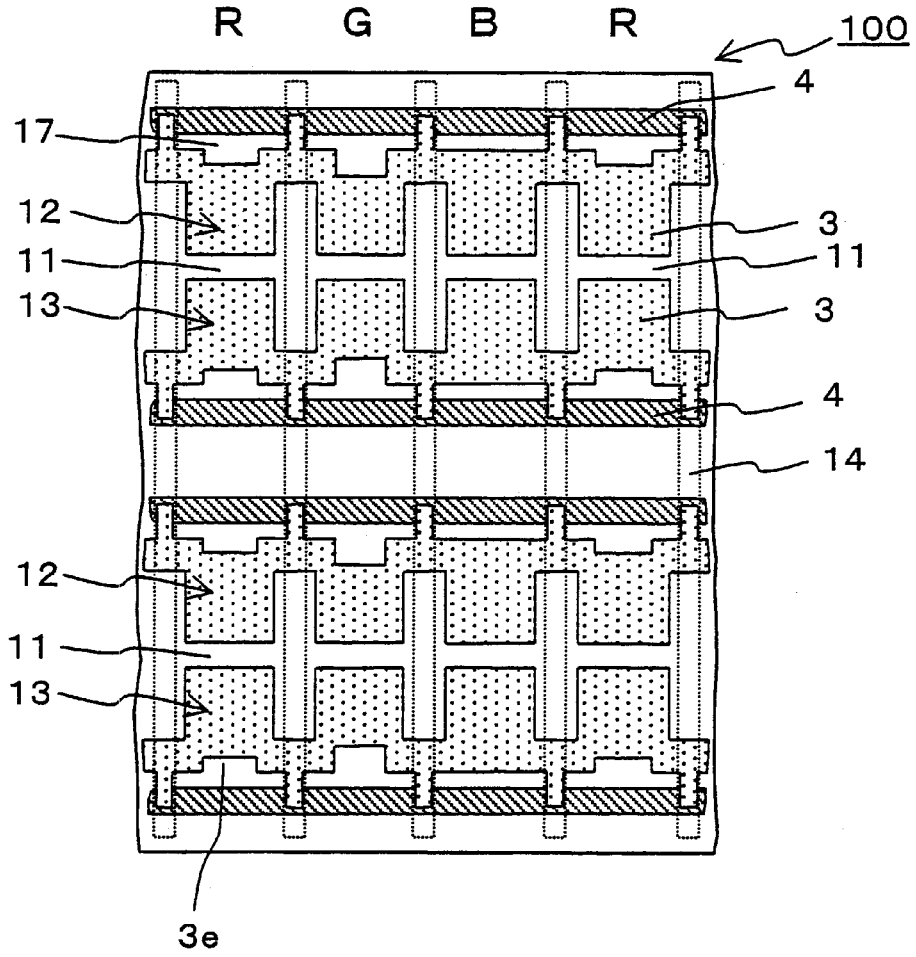
FIG. 12 is an elevational view illustrating an electrode structure of a color plasma display panel in accordance with a twelfth embodiment of the present invention.

FIG. 12 illustrates a plasma display panel according to the embodiment 12 of the present invention. The structure of the plasma display panel according to the embodiment 12 is the same as that of the embodiment 11, except that the widths of the gaps 17 between the transparent electrodes 3 and the bus electrodes 4 are the same for every color. Also, in the embodiment 12, each of the transparent electrodes 3 has recessed portions 3*e* on the side opposite from the surface discharge gaps 11, i.e., on the side of the bus electrode 4. The depth and/or width of the recessed portions 3*e*, that is, areas of the recessed portions, are adjusted for respective colors.

As alternative ways, it is also possible to provide slits 15 at the transparent electrodes 3 as in the embodiment 4, or to provide constricted or narrow portions at the transparent electrodes 3 to control areas of surface discharge electrodes.

Next, embodiments of the present invention will be explained in which transparent electrodes 3 are separated into individual transparent electrode portions 3*g* which are mutually and electrically coupled by the bus electrodes 4.

Figure 13:
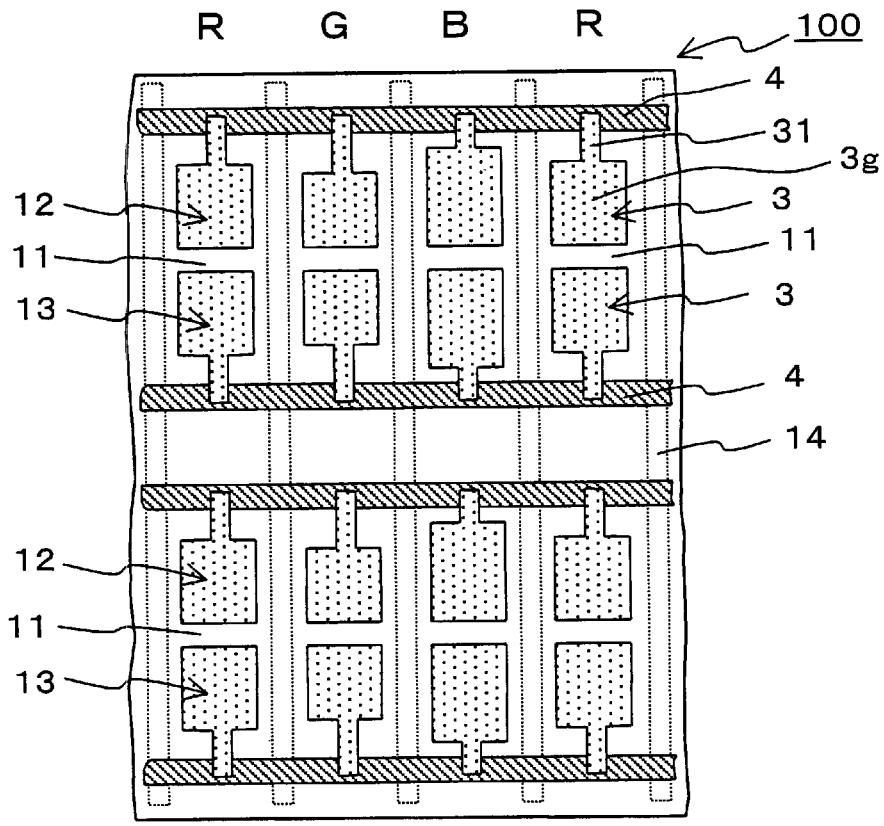
FIG. 13 is an elevational view illustrating an electrode structure of a color plasma display panel in accordance with a thirteenth embodiment of the present invention.

In the embodiment 13 of FIG. 13, each of the transparent electrode portions 3*g* has approximately rectangular shape and is coupled to the bus electrode 4 via a narrow connecting portion 31. The widths of rectangular portions of the transparent electrode portions 3*g* which occupy almost all area of surface discharge electrodes are the same for every color, but lengths of the rectangular portions differ every color.

Figure 14:
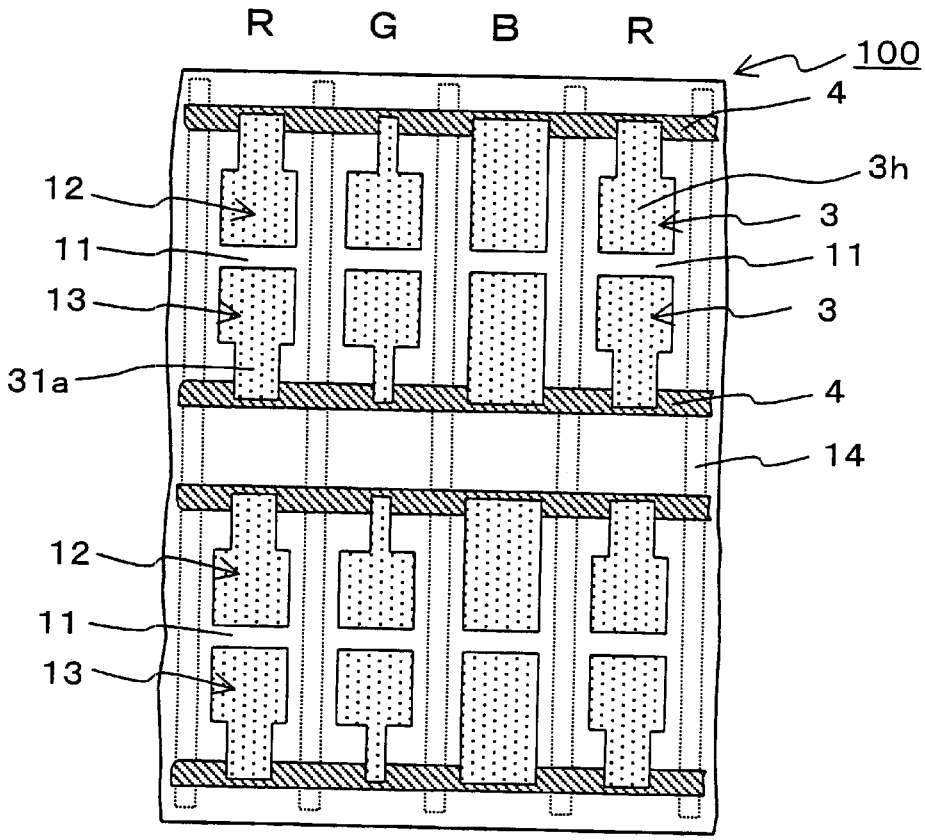
FIG. 14 is an elevational view illustrating an electrode structure of a color plasma display panel in accordance with a fourtheenth embodiment of the present invention.

In the embodiment 14 of FIG. 14, each of the transparent portions 3*h* has approximately rectangular shape and is coupled to the bus electrode 4 via a connecting portion 31*a* formed on the side of the bus electrode 4. The widths of rectangular portions of the transparent electrode portions 3*h*are the same for every color. However, widths of the connecting portions 31*a* are adjusted for every color.

Figure 15:
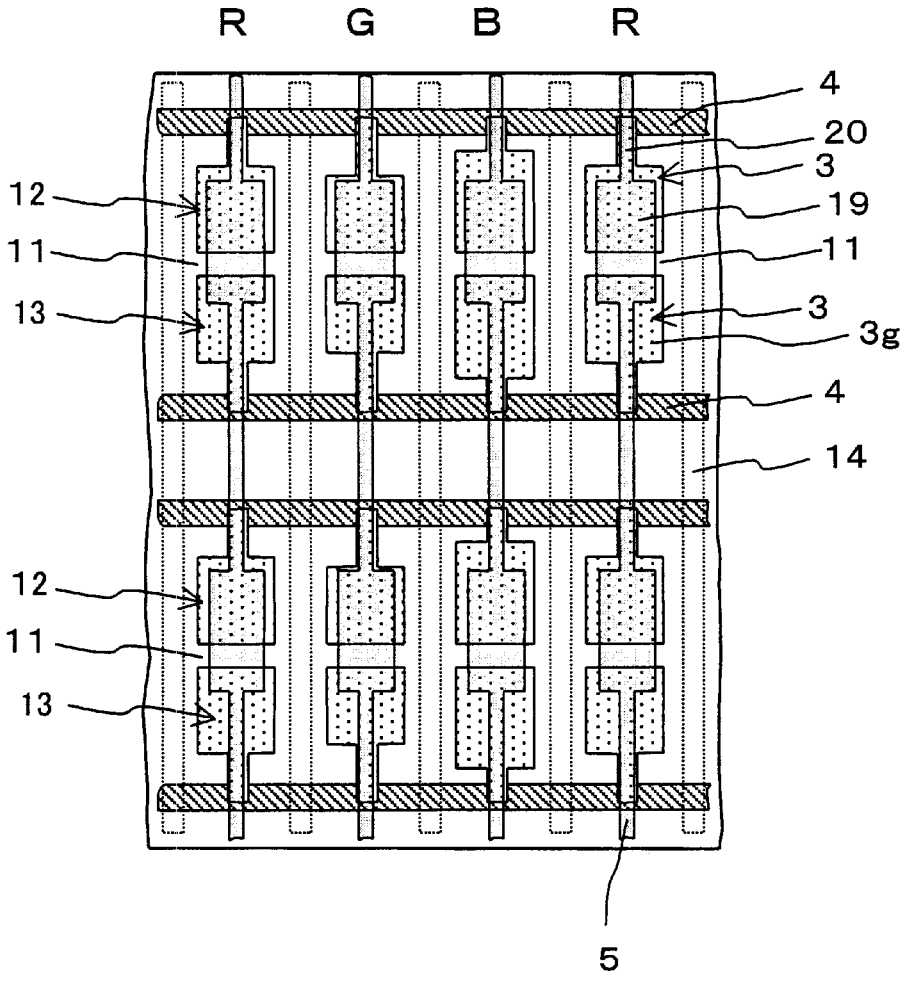
FIG. 15 is an elevational view illustrating an electrode structure of a color plasma display panel in accordance with a fifteenth embodiment of the present invention.

As a method of improving variation of the drive characteristics of every color, it is also effective to devise shapes of data electrodes 5, as shown the embodiment of FIG. 15. In this embodiment, each of the data electrodes 5 has wide portions 19 which are formed approximately at portions facing scanning electrode portions near the surface discharge gaps 11. In the portions of the scanning electrodes far from the surface discharge gaps 11, each of the data electrodes 5 are formed as narrow portions 20. By using data electrodes 5 having such shape, it is possible to uniform the write-in characteristics of every color.

The color plasma display panels according to the eighth through fifteenth embodiments constituted as mentioned above have the following advantageous effects, in addition to the advantageous effects of the color plasma display panels according to the first through seventh embodiments.

In the eighth through fifteenth embodiments, it is possible to finely and precisely adjust the area of discharge electrode for each color by changing the shape of the electrode every color. Also, in case the connecting portions 4*a* (FIG. 11) are formed by using the same metallic material as that of the bus electrodes 4, it is possible to integrally form the connecting portions 4*a* and the bus electrodes 4, and to electrically couple the transparent electrode portions with low resistance. Further, it is possible to realize uniform write-in characteristics for every color, by changing the shapes of the data electrodes (FIG. 15).

Although various embodiments are described above, it should be understood that the essence of the present invention is to adjust area of electrodes which function as discharge electrodes contributing to light emission every color cell, depending on the performance of the fluorescent substances 9 used, color temperature of white color to be realized and deviation of white color from the blackbody radiation curve. Contribution of the area of each electrode to the luminance is not the same throughout the shapes of electrodes mentioned above. However, in practice, it is possible to design each electrode assuming that the luminance is proportional to the area of the electrode. If necessary, it is possible to measure luminance of each color and to readjust the areas of the electrodes such that the desired color temperature of white and so on is obtained. In the fluorescent substances 9 available at present, luminance of blue color is relatively small, and it is necessary to decrease the area of electrodes of each of the green and red cells by approximately 20 percents, to realize the color temperature of white of about 8000 degrees Kelvin. Also, by decreasing the area of each of the green and red cells by approximately 30 percents, it is possible to realize high color temperature of white of 9300 degrees Kelvin. Of course, according to the improvement in the fluorescent substance in near future, the area of electrodes can be adjusted.

Also, there is a possibility that discharge voltages differ every color because of the variation of the area of the electrodes and thereby drive margin is deteriorated.

However, according to another advantages of the present invention, such deterioration of the drive margin can be improved. That is, another essence of the present invention is to utilize the phenomenon that the discharge first occurs in the proximity of the surface discharge gaps, to make the shape of the electrodes similar to each other for every color in the proximity to the surface discharge gaps, and to adjust the areas of the electrodes for every color at the portions far from the surface discharge gaps 11. By this way, it is possible to adjust operating characteristics of display cells every color and to avoid deterioration of the drive margin. All the embodiments 1 through 14 mentioned above satisfy these conditions. Preferably, the shape of the electrodes should be the same for every color in the area from the end portions on the side of the surface discharge gaps to at least 50 microns or more toward the bus electrodes.

As a way of further improving difference of drive characteristics for every color, it is also effective to change shapes of data electrodes 5, as shown the embodiment of FIG. 15. In that embodiment, each of the data electrodes 5 has wide portions 19 formed approximately at portions facing scanning electrode portions near the surface discharge gaps 11, and has narrow portions 20 at portions of the scanning electrodes 12 far from the surface discharge gaps 11. By using data electrodes 5 having such shape, it is possible to uniformalize the write-in characteristics of every color.

Luminance of light emission due to the retaining discharge in an AC surface discharge type plasma display panel is approximately proportional to the areas of electrodes. By changing the areas of the electrodes which produces retaining discharge every color, it becomes possible to adjust luminance of every color. Since the dependency of luminous efficiency on the area of the electrode is not so large, the deterioration of the luminous efficiency is relatively small, even if the areas of the electrodes are adjusted every color to obtain a desired balance of luminance. Also, the drive characteristics of the color plasma display panel, such as performance of write-in operation, tend to be determined by the shape and so on of portions in the proximity of the surface discharge gap. Therefore, by making the shape of the electrodes in such portions almost the same among every color and by changing the shape of the electrodes in portions far from the surface discharge gaps to change the area of the electrodes, it is possible to adjust the color temperature and the white balance, while keeping the drive characteristics of every color.

Although many embodiments are shown in the above, the shapes of the electrodes used for changing the areas of the electrodes for every color are not limited to those particularly shown in the above. Various other shapes, combination of shapes and modification of shapes can be used within the scope of the present invention.

Also, the number, location, shape and so on of each of the components of the plasma display panels described above are not limited to those of the embodiments mentioned above, but can be any number, location, shape and so on which are preferable in implementing the present invention.

In summary, the present invention constituted as described above has the following advantageous effects.

According to the present invention, it is possible to adjust the color temperature of white color, the deviation of white color and so on of the color plasma display panel as electrode patterns when the plasma display panel is designed. The electrode patterns adjusted can be easily fabricated by using, for example, photolithography technology.

In the present state of the art, performance of the fluorescent substance of blue color is relatively inferior to those of other colors and, therefore, the color temperature of white color was conventionally 6000 degrees Kelvin or so and deviation of white color from the blackbody radiation curve was also relatively large, so that greenish white color was displayed. However, in the color plasma display panel according to the present invention, color temperature of white color is equal to or higher than 8000 degrees Kelvin, and deviation of white color is also relatively small. Therefore, in the color plasma display panel according to the present invention, it is possible to obtain vivid white color comparable to a CRT display.

Further, in the color plasma display panel according to the present invention, the color temperature of white color can be adjusted precisely without deteriorating luminous efficiency, without decreasing the number of displayed gradation and without deteriorating a drive margin, contrary to the conventional method of adjusting them.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative sense rather than a restrictive sense, and all such modifications are to be included within the scope of the present invention. Therefore, it is intended that this invention encompasses all of the variations and modifications as fall within the scope of the appended claims.

What is claimed is:

1. A surface discharge type color plasma display panel comprising:

a plurality of discharge electrode pairs each pair of which includes a scanning electrode and a retaining electrode and each pair of which forms a surface discharge gap between said scanning electrode and said retaining electrode;

a plurality of data electrodes disposed perpendicular to said surface discharge gap; and a plurality of display cells each defined at an area including an intersection between said data electrode and said discharge electrode pair, said plurality of display cells being grouped into a plurality of sets of display cells, each set including display cells for three primary colors;

wherein said discharge electrode pair in each set of display cells having the same shape among said display cells of three primary colors in the proximity of said surface discharge gap, and having different shapes among said display cells of three primary colors at portions remote from said surface discharge gap.

2. A surface discharge type color plasma display panel as set forth in claim 1, further comprising isolation walls which are disposed parallel with said data electrodes and which define discharge spaces of said display cells, and wherein said scanning electrode and said retaining electrode comprise a pair of transparent electrodes.

3. A surface discharge type color plasma display panel as set forth in claim 1, wherein area of said discharge electrode pair in said display cell of blue color among said three primary colors is larger than area of said discharge electrode pair in each of said display cells of other colors.

4. A surface discharge type color plasma display panel as set forth in claim 1, wherein said scanning electrode and said retaining electrode are a pair of transparent electrodes, and each of said transparent electrodes has comb like shape in which recessed portions are formed from said surface discharge gap along portions facing isolation walls provided perpendicular to said surface discharge gap.

5. A surface discharge type color plasma display panel as set forth in claim 2, wherein end portions of said transparent electrodes on opposite side of said surface discharge gaps have stepped portions in locations which face portions between said isolation walls, and widths of said transparent electrodes in a direction along said isolation walls differ every color.

6. A surface discharge type color plasma display panel as set forth in claim 2, wherein end portions of said transparent electrodes on the side of said retaining electrodes on opposite side of said surface discharge gap have stepped portions in locations which face portions between said isolation walls, and widths of said transparent electrodes on the side of said retaining electrodes in a direction along said isolation walls differ every color.

7. A surface discharge type color plasma display panel as set forth in claim 2, wherein said transparent electrodes have slits which are formed on the portions opposite to said surface discharge gap and at locations facing portions between said isolation walls and whose sizes are changed every color to control color temperature of white color.

8. A surface discharge type color plasma display panel as set forth in claim 2, further comprising bus electrodes which extend parallel to said surface discharge gaps, which are disposed on the outside of said transparent electrodes and on the opposite side of said surface discharge gaps and which are electrically coupled with said transparent electrodes via connecting portions disposed along portions facing said isolation walls, wherein there are provided gaps between said transparent electrodes and said bus electrodes, said gaps being provided for changing areas of said discharge electrodes contributing to retaining discharge.

9. A surface discharge type color plasma display panel as set forth in claim 8, wherein shapes of said gaps are changed every color to control areas of said discharge electrodes contributing to retaining discharge.

10. A surface discharge type color plasma display panel as set forth in claim 2, wherein said transparent electrodes has recessed portions at location including portions facing said isolation walls which has approximately comb teeth like shape, wherein tip portions of said transparent electrodes which are not recessed are electrically coupled with said bus electrodes, and wherein widths, in the direction of said bus electrodes, of said transparent electrodes which are not recessed are different every color.

11. A surface discharge type color plasma display panel as set forth in claim 2, wherein said transparent electrodes have transparent electrode portions each of which has approximately rectangular shape, and lengths of said transparent electrode portions in the direction of said isolation walls differ every color.

12. A surface discharge type color plasma display panel as set forth in claim 2, wherein said transparent electrodes have transparent electrode portions each of which has approximately rectangular shape, and each of said transparent electrode portions has constricted portion on the side of said bus electrode.

13. A surface discharge type color plasma display panel as set forth in claim 2, wherein said transparent electrodes have recessed portions on the side of said surface discharge gap and at the location facing said isolation walls, and bus electrodes and said transparent electrodes are electrically coupled via connecting portions located at portions facing said isolation walls.

14. A surface discharge type color plasma display panel as set forth in claim 13, wherein said connecting portions are formed of a material which is the same as that of the bus electrodes.

15. A surface discharge type color plasma display panel as set forth in claim 13, wherein said transparent electrodes have recessed portions on the side of said surface discharge gap and at the location facing said isolation walls, and also have recessed portions on the side of said bus electrodes toward said surface discharge gap and at the location corresponding to portions between said isolation walls.

16. A surface discharge type color plasma display panel as set forth in claim 1, wherein said scanning electrodes and said retaining electrodes are transparent electrodes constituting discharge electrode pairs, said transparent electrodes have transparent electrode portions which are mutually separated by isolation walls, which have approximately rectangular shape and which have connecting portions having narrow band shape, said transparent electrode portions and bus electrodes are electrically coupled via said connecting portions, and length of said connecting portions differ every color.

17. A surface discharge type color plasma display panel as set forth in claim 1, wherein said scanning electrodes and said retaining electrodes are transparent electrodes constituting discharge electrode pairs, said transparent electrodes have transparent electrode portions which are mutually separated by isolation walls, which have approximately rectangular shape and which have connecting portions for electrically coupling said transparent electrode portions and bus electrodes, and width of said connecting portions differ every color.

18. A surface discharge type color plasma display panel as set forth in claim 1, wherein width of each of said data electrodes is wider at portions facing end portions of said scanning electrode on the side of said surface discharge gap than at portions facing other end portions of said scanning electrode on opposite side of said surface discharge gap.

19. A surface discharge type color plasma display panel as set forth in claim 2, wherein fluorescent substance of three primary colors are sequentially applied on regions between said isolation walls.

* * * * *